US005832667A

United States Patent [19]

Buening et al.

[11] Patent Number: 5,832,667

[45] Date of Patent: Nov. 10, 1998

[54] SELF ALIGNING WINDOW REGULATOR

[75] Inventors: Dennis J. Buening, Northville; David A. Hill, Royal Oak; Kevin A. McKenna, Livonia, all of Mich.

[73] Assignee: Excel Industries, Inc., Elkhart, Ind.

[21] Appl. No.: 748,282

[22] Filed: Nov. 13, 1996

[51] Int. Cl.[6] ..... E05D 15/10

[52] U.S. Cl. ..... 49/212; 49/352; 49/348

[58] Field of Search ..... 49/452, 352, 348, 49/349, 208, 209, 212

[56] References Cited

U.S. PATENT DOCUMENTS

| | | | |
|---|---|---|---|
| 2,449,210 | 9/1948 | Faust | 49/452 |
| 2,481,535 | 9/1949 | Roethel | 49/452 X |
| 2,494,040 | 1/1950 | Floraday | 49/452 |
| 3,333,363 | 8/1967 | Garvey | 49/374 X |
| 4,747,232 | 5/1988 | Stephenson et al. | 49/452 |
| 5,038,519 | 8/1991 | Huebner . | |
| 5,074,077 | 12/1991 | Toyoshima et al. . | |
| 5,469,663 | 11/1995 | TenBrink et al. . | |
| 5,502,926 | 4/1996 | Grace et al. . | |

FOREIGN PATENT DOCUMENTS

| | | | |
|---|---|---|---|
| 2843633 | 4/1980 | Germany | 49/375 |

*Primary Examiner*—Jerry Redman
*Attorney, Agent, or Firm*—Banner & Witcoff Ltd.

[57] ABSTRACT

A self-aligning window regulator for raising and lowering a windowpane in a motor vehicle door, having a mounting assembly fixed to the door comprising at least a mounting bracket, and a self-aligning assembly slidably attached to the mounting assembly at the mounting bracket. In certain preferred embodiments the self-aligning assembly includes a rail, a glider slidable over the rail, and attachment for connecting the glider to the windowpane. Connection element positioned between the rail and the mounting bracket allows the rail and the rest of the self-aligning assembly to float relative the mounting bracket. Preferably the connection element comprises a rivet extending from either the mounting bracket or the rail into a slot. The rivet can slide relative the slot and allow the self-aligning assembly to move relative the mounting bracket to accommodate stack-up tolerances or misalignments of the regulator componentry. To reduce potential rattle between the rivet and the slot, an elastomeric grommet may be positioned around the rivet. To reduce potential rattle between the mounting bracket and the rail, biasing members such as cup washers may be used, urging these components of the window regulator out of contact with one another.

11 Claims, 3 Drawing Sheets

SELF ALIGNING WINDOW REGULATOR

FIELD OF THE INVENTION

The present invention generally relates to mechanisms controlling the motion of windowpanes in motor vehicles, and more particularly to an enhanced design allowing for a windowpane to float relative a window regulator, that is, enabling the windowpane, within a certain range to self-align by changing its position relative to the door to prevent binding and reduce seal wear.

BACKGROUND OF THE INVENTION

Window regulators are used to control the motion of a windowpane, such as the glass that is positioned in the door of a motor vehicle. One example of a window regulator is the cable and drum variety, which typically has a cable connected between a drive means, including a rotatable drive drum, and a glider which is rigidly attached to windowpane connecting componentry. The glider slides in a generally up and down direction over a rail. The rail typically is rigidly attached to an upper and lower door mounting bracket.

It is preferable that the windowpane slide in channels to guide the glass with seals to keep out the elements and to reduce wind noise. Several flaws can result in window regulator assemblies when they are installed into the motor vehicle door, resulting in a slowing of the rate of travel of the windowpane sliding in the door and rapid seal wear. If the problems are severe enough, the windowpane may even jam. Specific flaws that may lead to these problems include, for example, that the channels may not be completely parallel with both one another and with the rail, the door may be otherwise misaligned, the window regulator componentry may not be of the proper dimensions, stack-up tolerances between regulator componentry may exceed design allowance, or any combination of these.

Previous attempts to address the problems associated with stack up tolerance errors and misalignment include specifying the order of assembly of the window regulator in the motor vehicle door and enlarging the mounting holes into slots at which the upper door mounting bracket is attached. In such cases, the regulator is first attached to the door at the lower mounting bracket. Next, the regulator is attached to the windowpane. Then the regulator is cycled to the full up position. Only then is the regulator attached to the door at the upper mounting bracket. However, once the rivets are attached at the upper door mounting bracket the regulator is rigidly fixed to the door. If misalignment or tolerance errors exist, the aforesaid problems of premature seal wear, slow travel times and, in extreme cases, jamming can still occur.

Another proposed solution to the problem of binding and seal wear is disclosed in U.S. Pat. No. 5,038,519 to Huebner which teaches a spring mounted pin attached to a carrier. The pin extends through a slot in a bracket which is in turn affixed to a metal plate carrying the windowpane. Spring washers between the free end of the pin and the bracket resist, but allow, relative movement between the bracket and the carrier. This in turn allows the windowpane to have limited fore and aft and inboard-outboard adjustment. However, this design is relatively complex and difficult to assemble.

In view of the foregoing, it is an object of the present invention to provide a window regulator of simple design which allows the windowpane to cycle properly even in the event of errors in sizes or positioning of the parts or stack up tolerances.

It is an object of at least certain preferred embodiments of the present invention to provide a self-aligning window regulator which reduces aesthetically unappealing squeaks and rattles associated with the window regulator.

It is another related object of the present invention to provide such a window regulator that is relatively simple to assemble and highly reliable in operation.

SUMMARY

In accordance with these and other objects, there is provided a self-aligning window regulator for raising and lowering a windowpane in a motor vehicle door, which allows the position of the windowpane to adjust as it travels along its travel path, particularly in the fore-aft directions. The regulator preferably has anti-rattle means for reducing noises generated when components of the window regulator slide past one another.

In accordance with one aspect, the self-aligning feature window regulator, which has a mounting assembly which comprises at least a door mounting bracket rigidly attached to the door. A self- aligning assembly comprises at least the windowpane and a glass attachment bracket. A connector or connection device, such as a rivet or bolt, is connected to either the mounting assembly or the self-aligning assembly. The connector extends into a slot in the other assembly. If, as the windowpane travels along its travel path, it begins to bind against the run channels or the seals, the force will be transmitted back to the rivet-slot connection, and the self-aligning assembly will move relative the fixed-position mounting assembly. This will reduce the forces exerted on the seals and channels to provide for the smooth, fluid motion of the windowpane as it travels between the full up and the full down position.

To reduce any rattling or other noises that may occur, a pair of biasing members, such as cup washers, can be positioned on both sides of the slot, urging, for example, the first assembly away from the self-aligning assembly. To minimize potential rattling between the connector and the slot, an elastomeric grommet may be positioned around the connector.

In accordance with another aspect, a cable-drum window regulator is self-aligning between window or glass run channels, defining at least part of the window opening in a motor vehicle door. Drive means including a drive motor or hand crank and at least one cable, are connected to a glider. The glider slides on a rail which is mounted in the door at upper and lower mounting brackets. The glider is attached to the windowpane by attachment means. Operation of the drive means causes the cable to pull on the glider and carry the windowpane between the full down and full up positions.

To accommodate for stack-up tolerances and/or misalignment of components in the motor vehicle door, the upper bracket is provided with a slot and the rail has a connector, such as a rivet, extending into the slot. The rail is sufficiently flexible to allow relative motion between the rail and the upper bracket without having a self-aligning feature on the lower mounting bracket. A nut may be positioned at one end of the rivet, and cup washers may be positioned to reduce rattle between the rail, bracket and nut. Alternatively, the rivet and slot may be reversed, such that the rail has the slot and the upper bracket has the rivet.

From the foregoing disclosure and the following more detailed description of various preferred embodiments, it will be apparent to those skilled in the art that the present invention provides a significant advance in the technology and art of window regulators, particularly cable-drum window regulators. Particularly significant in this regard is the potential the invention affords for a low cost design that allows the windowpane to float in the window opening relative to the fixed position mounting brackets. Additional features and advantages of various preferred embodiments will be better understood in view of the detailed description provided below.

Figure 1:
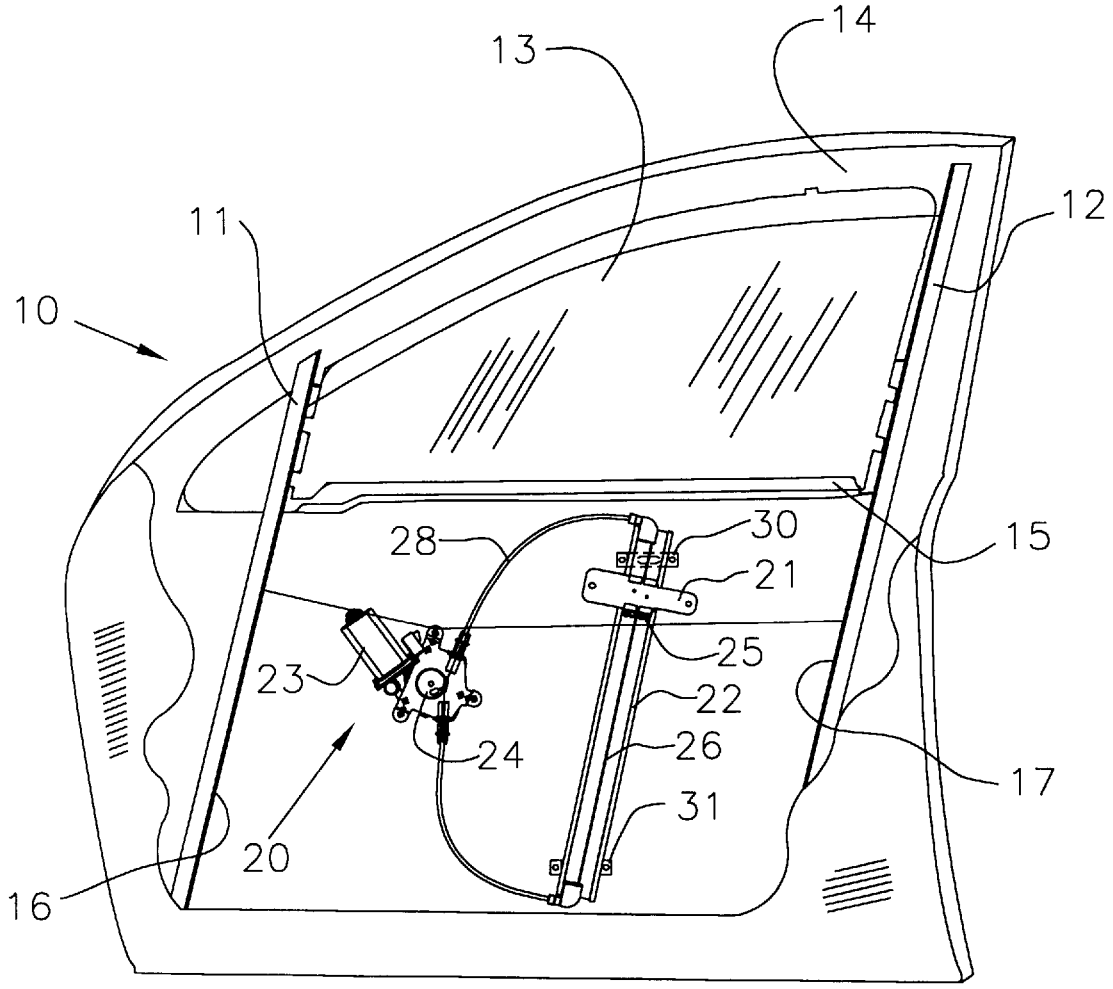
FIG. 1 is an elevation view of a motor vehicle door, partially cut away, revealing a self-aligning window regulator having anti-rattle means in accordance with a preferred embodiment.

It should be understood that the appended drawings are not necessarily to scale, presenting a somewhat simplified representation of various preferred features illustrative of the basic principles of the invention. The specific design features of a self-aligning window regulator as disclosed here, including, for example, the rivet or bolt and the nut or other locking means such as peeled projections produced by a mandril will be determined in part by the particular intended application and use environment. Certain features of the illustrated embodiments have been enlarged or distorted relative to others to facilitate visualization and clear understanding. In particular, thin features may be thickened, and the dimensions of the slot and the biasing members may be modified for clarity of illustration. All references to direction and position, unless otherwise indicated, refer to the orientation of the self-aligning, window regulator illustrated in the drawings. In general, the fore and aft directions refers to left and right directions in the plane of the paper in the side view of FIG. 1, and up, down or vertical refers to corresponding up, down and vertical directions in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the self-aligning window regulators disclosed herein. The following detailed discussion of various alternative and preferred features and embodiments will illustrate the general principles of the invention with reference principally to a cable-drum window regulator for use in a motor vehicle. Other embodiments suitable for other applications, will be apparent to those skilled in the art given the benefit of this disclosure.

Referring now the drawings, FIG. 1 shows a motor vehicle door 10, partially cut away, revealing a window regulator assembly 20 in accordance with a preferred embodiment. The regulator 20 has a drive means which includes a motor 23 affixed to an inner panel of the door, typically a permanent magnet dc motor, and a drive drum 24. Cables 26,28 are attached to the drive drum at one end and to the glider 25 at the other end. The glider 25 is attached, optionally by snap fit to a bracket 21, which in turn is bolted or riveted to the windowpane 13. Alternate methods of attaching the glider 25 to the bracket 21, can be used within the scope of this invention, such as injection molding a plastic glider around a metal bracket. Alternative methods of attaching the bracket 21 to the windowpane 13 can be used within the scope of this invention as well, such as bonding a glass attachment bracket to the lower edge of the windowpane and attaching the bracket with the glider to the glass attachment bracket.

Operation of the motor 23 causes one cable to unwrap and one cable to wrap around the drive drum 24, pulling on the glider which slides up and down along a rail 22, moving the windowpane 13 up and down along its travel path. A mounting assembly may, in certain embodiments comprise simply mounting brackets 30,31 separately attached to the door panel or a door securing the window regulator to the door at holes 34.

In typical front doors of motor vehicles, the windowpane travels in run channels 11 and 12 from a full up position wherein the windowpane contacts the header 14 to a full down position in which the windowpane is positioned below the beltline 15. Seals 16, 17 are positioned around or in the run channels to keep out the elements and to reduce wind noise.

Figure 2:
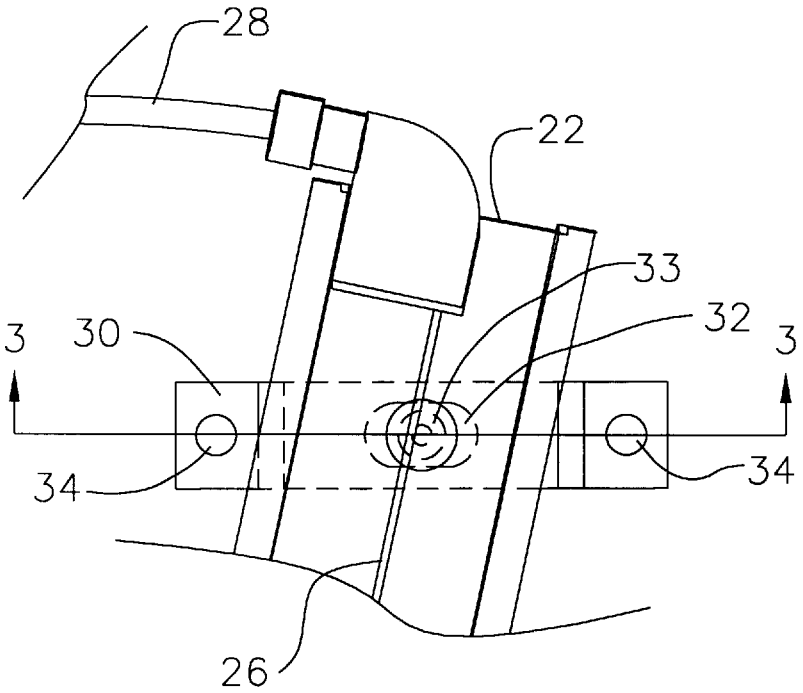
FIG. 2 is an elevation view of the upper door mounting bracket and an upper portion of the rail, revealing a slot that allows the rail to slide relative the door mounting bracket.

Misalignment and stack-up tolerances may produce premature seal wear, slower cycle times or even jamming of the windowpane in the run channel. To address this problem there is provided connector 33 and a slot 32 between one of the mounting brackets, preferably the upper mounting bracket 30, and the rail 22. In the preferred embodiment shown best in FIGS. 2 & 3, the slot 32 is in the mounting bracket 30 and the connector 33 is a rivet affixed to the rail. The rail 22 is sufficiently flexible in fore and aft directions to allow the connector to move from either end of the slot 32 even when rigidly attached to the door at the lower mounting bracket 31. If the rail 22 is not parallel with the run channels 11, 12, or if stack up tolerances of the window regulator componentry result in misalignment of the windowpane 13, then the rivet will be urged in either a fore or aft direction to compensate, allowing for smooth operation of the window regulator.

The term connector is used generically to mean fastening devices including rivets, studs and bolts and other similar connecting means. In the embodiment disclosed in the FIGS. 1–3, the rivet 33 has a first end 38 which is rigidly attached to the rail 22, and a second end 39. The rail 22 and attachment bracket may be sandwiched between the ends of the rivet by numerous techniques, as for example by a nut 40 with a thread locking adhesive, an oval head nut, a weld nut, a banana peel rivet, etc.

In a preferred embodiment the rail is non-rotatably attached to the door at the lower mounting bracket but is sufficiently flexible to allow for limited movement between the rail and the upper mounting bracket.

It will be readily apparent to those skilled in the art given the benefit of this disclosure that the slot and rivet could be reversed such that the rail has t he slot and the upper door mounting bracket has the rivet fixedly attached to itself and extending into the slot.

Figure 3:
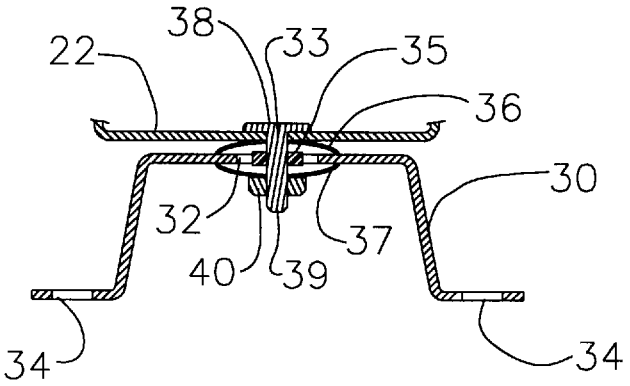
FIG. 3 is a cross section view of the self-alignment feature taken along the line 3—3 in FIG. 2 revealing anti-rattling means.
Figure 4:
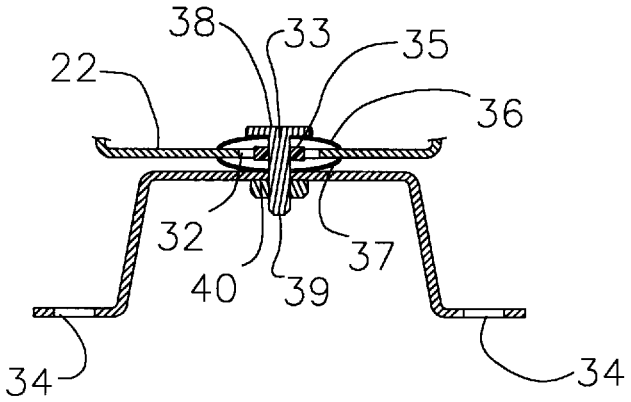
FIG. 4 is a cross section view of an alternative preferred embodiment of the self-alignment feature showing a slot positioned in a rail.

To reduce vibrational noises, rattles and other potential kinds of noise problems that can occur when two metal parts that are allowed to slide over one another, an elastomeric grommet 35 is positioned around the rivet so that it contacts the slot directly, instead of having the rivet contact the slot directly. Furthermore, as best shown in FIG. 3, to prevent the rail 22 from contacting the mounting bracket 30, biasing members such as cup washers 36, 37 are positioned on either side of the mounting bracket 30, urging the nut 40 and the rail out of contact with the mounting bracket 30. It will be readily apparent to those skilled in the art given the benefit of this disclosure, that when instead the slot 32 is in the rail 22, the cup washers should be correspondingly positioned on opposite sides of the rail, urging the nut and the mounting bracket away from the rail 22.

From the foregoing disclosure and detailed description of certain preferred embodiments, it will be readily apparent to those skilled in the art that various modifications, additions and other alternative embodiments are possible without departing from the true scope and spirit of the invention. For example, the glider may be, instead of being fixedly attached to a glider bracket, either through snap fit or by injection molding, may be slidably attached to the glider bracket with a rivet and slot in a manner similar to that described above. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A window regulator comprising, in combination:

a mounting assembly comprising at least a mounting bracket affixable to a door;

a windowpane movable in a travel direction in a travel range between an open position and a closed position;

a self-aligning assembly guiding the windowpane over its travel range and slidably adjustable in response to movement of the windowpane over its travel range, comprising an elongate rail having first and second rail ends, fixed near the first rail end to the mounting assembly and slidably connected near the second rail end to the mounting bracket, wherein the second rail end is slidable in compliance with the windowpane in a direction generally perpendicular to the travel direction of the windowpane; and connection means for slidably connecting the mounting assembly to the self-aligning assembly at the mounting bracket, comprising a connector having first and second ends and being attached to one of the mounting bracket and the self-aligning assembly and slidably received in a slot in the other of the mounting bracket and the self-aligning assembly.

2. The window regulator of claim 1 further comprising anti-rattle means for controlling vibrational noise and rattle comprising a first biasing member positioned between the mounting assembly and the self-aligning assembly to urge the self-aligning assembly away from the mounting assembly, and a second biasing member positioned between the connector and one of the mounting assembly and the self-aligning assembly.

3. The window regulator of claim 2 wherein the biasing members are cup washers.

4. The window regulator of claim 2 wherein the anti-rattle means further comprises an elastomeric gasket positioned around the connector to dampen vibrational noise between the connector and the slot.

5. The window regulator of claim 2 further comprising a nut positioned near the second end of the connector, wherein the second biasing member is secured between the nut and the self-aligning assembly, urging the self-aligning assembly away from the nut.

6. The window regulator of claim 1 wherein the slot is located in the mounting bracket and the connector is a bolt secured by a nut, and the bolt is attached to the rail and extends through the slot in the mounting bracket.

7. The window regulator of claim 1 wherein the slot is located in the rail and the connector is a rivet which slides in the slot.

8. A cable-drum window regulator comprising, in combination:

fore and aft glass run channels extending substantially vertically in a window opening in a door, and receiving respectively, a fore edge and an aft edge of a windowpane;

a lower mounting bracket affixed to the door;

an elongate rail affixed to the lower mounting bracket;

a glider slidably attached to the rail;

drive means for raising and lowering the windowpane, comprising a drive motor and at least one cable connected between the drive motor and the glider;

attachment means for attaching the glider to the windowpane; and an upper bracket affixed to the door, wherein one of the upper bracket and the rail is provided with a slot, and the other of the upper bracket and the rail is provided with a rivet extending into the slot;

wherein the rail is slidably adjustable in response to movement of the windowpane and is sufficiently flexible to allow relative movement of the rail with respect to the upper bracket over an entire length of the slot without relative movement at an attachment between the rail and the lower bracket.

9. The cable-drum window regulator of claim 8 wherein the windowpane is self-aligning in inboard-outboard and fore-aft directions between the fore and aft glass run channels.

10. The cable-drum window regulator of claim 8 wherein cup washers are positioned adjacent the upper bracket to minimize vibrational noise and rattle.

11. The cable-drum window regulator of claim 8 further comprising an elastomeric grommet positioned around the rivet to dampen vibrational noise between the rivet and the slot.

* * * * *